US005903801A

United States Patent [19]

Nakamura

[11] Patent Number: 5,903,801

[45] Date of Patent: May 11, 1999

[54] IMAGE FORMING APPARATUS HAVING A FUNCTION FOR MONITORING THE NUMBER OF FORMED IMAGES

[75] Inventor: Hidenobu Nakamura, Toyokawa, Japan

[73] Assignee: Minolta Co., Ltd., Osaka, Japan

[21] Appl. No.: 08/948,361

[22] Filed: Oct. 10, 1997

[30] Foreign Application Priority Data

Oct. 11, 1996 [JP] Japan ..... 8-269692

[51] Int. Cl.[6] ..... G03G 21/00

[52] U.S. Cl. ..... 399/79; 235/382; 399/80

[58] Field of Search ..... 399/8, 10, 79, 399/80; 340/825.06, 825.15; 364/138; 235/375, 380, 382, 382.5

[56] References Cited

U.S. PATENT DOCUMENTS 5,212,519 5/1993 Kasahara et al. ..... 235/382 X

FOREIGN PATENT DOCUMENTS 61-032862 2/1986 Japan .

05241389 9/1993 Japan .

06187061 7/1994 Japan .

07248708 9/1995 Japan .

*Primary Examiner*—Arthur T. Grimley

*Assistant Examiner*—Quana Grainger

*Attorney, Agent, or Firm*—McDermott, Will & Emery

[57] ABSTRACT

A group code which is a code indicating a user group, an identification code which is a unique code assigned to each group, and image formation frequency data which is data indicating a frequency of image forming operations by each group are stored in a storage unit, related to each other. After receiving an identification code from an input unit, an identification code judging unit judges whether the received identification code matches any identification code stored in the storage unit. If an identification code judging unit judges that the received identification code matches a stored identification code, a calculating unit calculates the frequency of image forming operations performed after the identification code is received, and the image formation frequency data of the group in the storage unit corresponding to the received identification code is rewritten according to the frequency of image forming operations calculated by the calculating unit.

27 Claims, 16 Drawing Sheets

Fig. 6A

SECTION MONITOR STORAGE UNIT M1

| MEMORY ADDRESS | CONTENT | |
|---|---|---|
| 0001 | 0001 | ← SECTION NUMBER |
| 0002 | 1234 | ← COUNT DATA |
| 0003 | 0012 | ← SECTION NUMBER |
| 0004 | 2345 | ← COUNT DATA |
| | ⋮ | |
| 0199 | 0999 | ← SECTION NUMBER |
| 0200 | 4567 | ← COUNT DATA |

Fig. 6B

SECTION MONITOR TABLE T

| ID | MEMORY ADDRESS OF SECTION NUMBER |
|---|---|
| ○○○○ | 0001 |
| ○×○× | 0003 |
| ⋮ | ⋮ |
| ○×△□ | 0199 |

Fig. 8

SECTION MONITOR STORAGE UNIT M2

| SECTION NUMBER | COUNT DATA |
|---|---|
| 0001 | 1334 |
| 0002 | 4512 |
| 0003 | 1600 |
| 0004 | 3364 |
| | |
| | |
| 0998 | 0100 |
| 0999 | 6067 |
| 1000 | 4210 |

IMAGE FORMING APPARATUS HAVING A FUNCTION FOR MONITORING THE NUMBER OF FORMED IMAGES

BACKGROUND OF INVENTION (1) Field of the Invention

The present invention relates to an image forming apparatus, such as a copying machine or a printer, and a monitor system which can monitor the frequency of image formation performed by different groups of users.

(2) Description of the Prior Art

Copying machines are often shared by sections in an organization such as a firm. In such case, the number of copies made by each section which uses the copying machines is monitored for budget control and other purposes.

Conventionally, to monitor the number of copies made by each section, section numbers which indicate each section, and secret identification codes which are allocated to each section (hereinafter called "IDs") are registered beforehand After a user inputs the ID of his/her section, the user is permitted to make copies, with the number of copies made by the user's section being counted.

For this purpose, a memory in a conventional copying machine is provided with a section monitor storage unit for storing the number of copies made by each section and a section monitor table for storing IDs which are allocated to each section. For instance, the section monitor storage unit may have 100 storage areas, each section number may correspond with the address numbers (001–100) in the storage unit, and the number of copies made by a section indicated by an address number may be stored in the corresponding address area. On the other hand, in the section monitor table, IDs which are assigned to each section and the address numbers which correspond with each section in the section monitor storage unit are recorded, with the IDs and the address numbers being related to each other.

In such a copying machine, a user who wishes to make copies inputs the ID of his/her section and is permitted to make copies only when the ID is registered in the section monitor table. An address corresponding with the ID is read from the section monitor table and the number of copies made by the user after receiving permission is added to the number stored in the storage area of the read address number.

With the copying monitor method described above, users are permitted to make copies after a certain ID is inputted. The number of copies is stored in a storage area of an address number that matches a section number which corresponds with the ID in the section monitor storage unit. As a result, the number of copies made by each section can be easily monitored.

In the monitoring method described above, memory addresses are described as corresponding with section numbers. This means that in a large firm with 1000 or more sections, it is necessary to provide as many storage areas in the section monitor storage unit and in the section monitor table as there are sections in the entire firm.

However, it seems unrealistic that a specific copying machine would be used by 100 or more sections even if the total number of sections in the firm is 1000, because each section or each group of sections will usually have its own copying machine. If each copying machine is provided with storage areas for 1000 sections regardless of such reality, a large amount of memory will go to waste. Also, should the number of sections happen to exceed 1000, the memory will need to be expanded to register the excess sections. These things are problematic.

To avoid such problems, the storage area of each copying machine may be given 100 address numbers, with sections which are likely to use the copying machine being listed and the section numbers being assigned in each copying machine separately. The number of copies corresponding with each section may be recorded in an address number in accordance with a section number assigned in each copying machine.

By doing so, however, the same address number of each copying machine is assigned to different sections. For instance, the address number 001 of the copying machine A may be assigned to the general affairs department and the address number 001 of the copying machine B may be assigned to the accounts department. This can cause confusion when the number of copies made by each section is totaled for all of the copying machines.

In the case where the number of copies made by each section is monitored by a host computer which is wired up to the plurality of copying machines, it is necessary to register the address numbers in each copy machine for each section, making the totaling process extremely complex.

SUMMARY OF THE INVENTION

The object of the present invention is to provide an image forming apparatus which can register unique group codes unrelated to address numbers of a memory without increasing the unused capacity of the memory used for monitoring the frequency of image formation, and which can accurately monitor the frequency of image formation made by any registered user group.

The object of the present invention is achieved by an image forming apparatus including: an image forming unit for forming an image on a sheet; a storage unit for storing group codes, identification codes, and pieces of image formation frequency data in a plurality of predetermined address areas so that each of the group codes is related to one of the identification codes and to one of the pieces of image formation frequency data, where each of the group codes is a code indicating a user group, each of the identification codes is a unique code assigned to each user group, and each of the pieces of image formation frequency data is a piece of data indicating a frequency of image forming operations by each user group; an input unit for receiving an identification code; an identification code judging unit for judging whether the received identification code matches one of the identification codes stored in the storage unit; a calculating unit for calculating, if the identification code is judged to match one of the identification codes stored in the storage unit, a frequency of image forming operations performed after the identification code is received by the input unit; and a rewriting unit for rewriting, according to the frequency of image forming operations calculated by the calculating unit, one of the pieces of image formation frequency data in the storage unit that is related to a user group corresponding to the received identification code.

With the stated construction, aside from the number of copies, the frequency of use of an image forming apparatus can be set as any amount indicating the extent of use of the image forming apparatus such as the amount of used toner, time period spent using the image forming apparatus, or percentage of use of the apparatus by each section.

The image forming apparatus in the present invention has the structure described above so that, unlike conventional methods, address numbers in a memory do not need to match group code numbers, and users can freely register only the group codes of groups they believe will use the image forming apparatus Therefore, the frequency of image formation can be monitored accurately without having to provide an excessively large amount of storage amount capacity in a storage unit.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 6A shows the section monitor storage unit in the copying machine.

FIG. 6B shows the section monitor table.

FIG. 8 shows the section monitor storage unit in the host computer.

DESCRIPTION OF THE PREFERRED EMBODIMENT

The following is a detailed explanation of an embodiment of the present invention, with reference to the drawings.

(1) Overall Structure of the Copying Machine Monitor System

Figure 1:
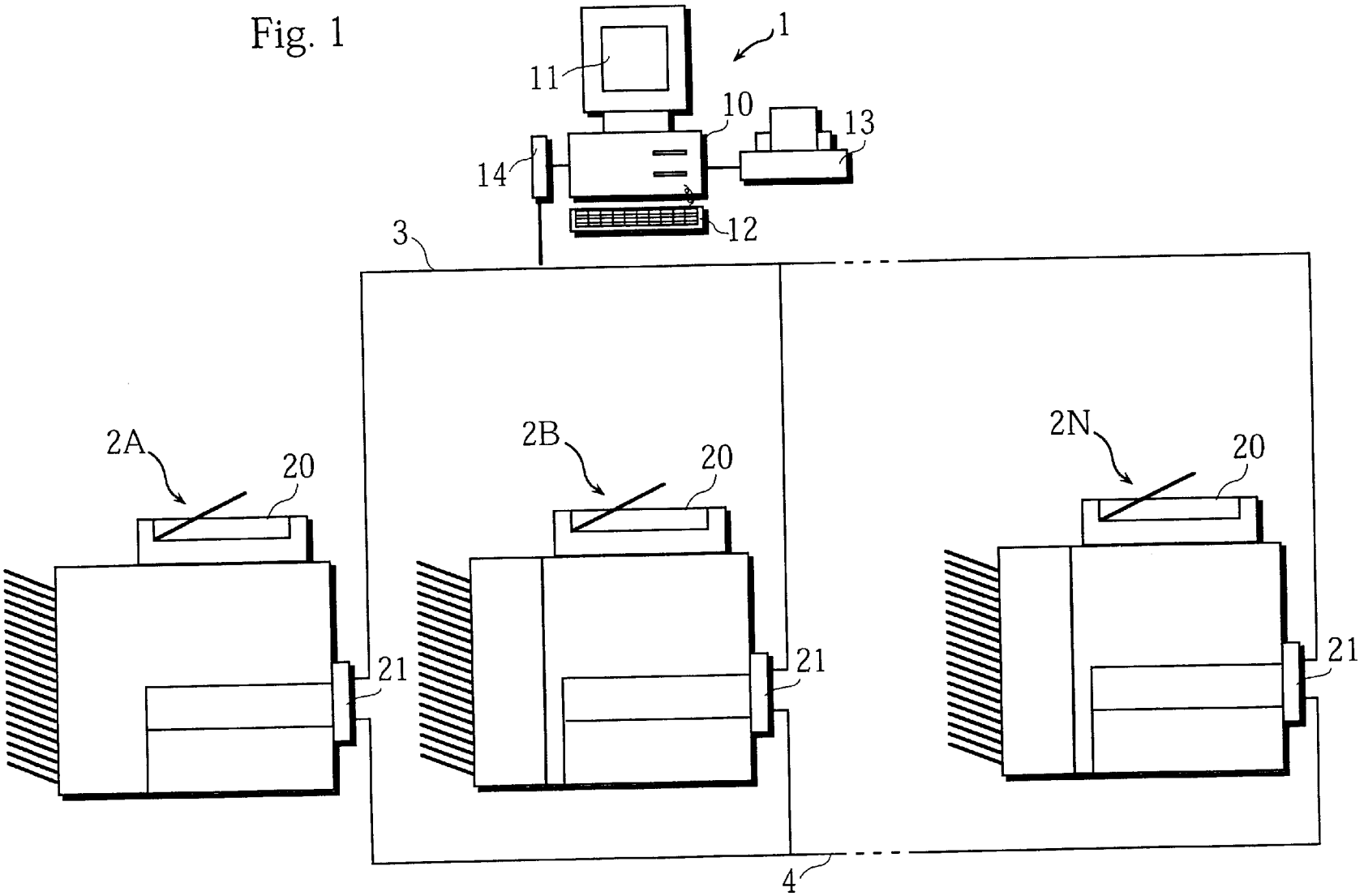
FIG. 1 shows an overall structure of the copying machine monitor system of the present invention.

FIG. 1 shows the overall structure of the copying machine monitor system of the present embodiment. The copying machine monitor system is used to monitor the number of copies made by each section in a firm, and comprises a host computer 1 provided at a service center and a plurality of copying machines 2A, 2B, . . . , and 2N which may be located on different floors of a building.

The host computer comprises a main computer unit 10, a display 11, a keyboard 12, a printer 13, and a modem device 14. Each of copying machines 2A, 2B, . . . , and 2N, comprises a main copying machine unit 20 and a modem device 21, and is connected to the host computer 1 via the modem device 21 and a public telephone line 3. Each of the copying machines 2A, 2B, . . . , and 2N is connected to each other via the modem device 21 and a private line 4 so that data can be transmitted and received between copying machines Note that these copying machines will be simply referred to as copying machines 2 when describing the common characteristics of copying machines 2A, 2B, . . . , and 2N.

The copying machine 2 is a well-known electrophotography copying machine which reads an image on an original document using a scanner, forms a toner image on a photosensitive drum, and transfers and fixes the toner image onto a paper sheet.

Figure 2:
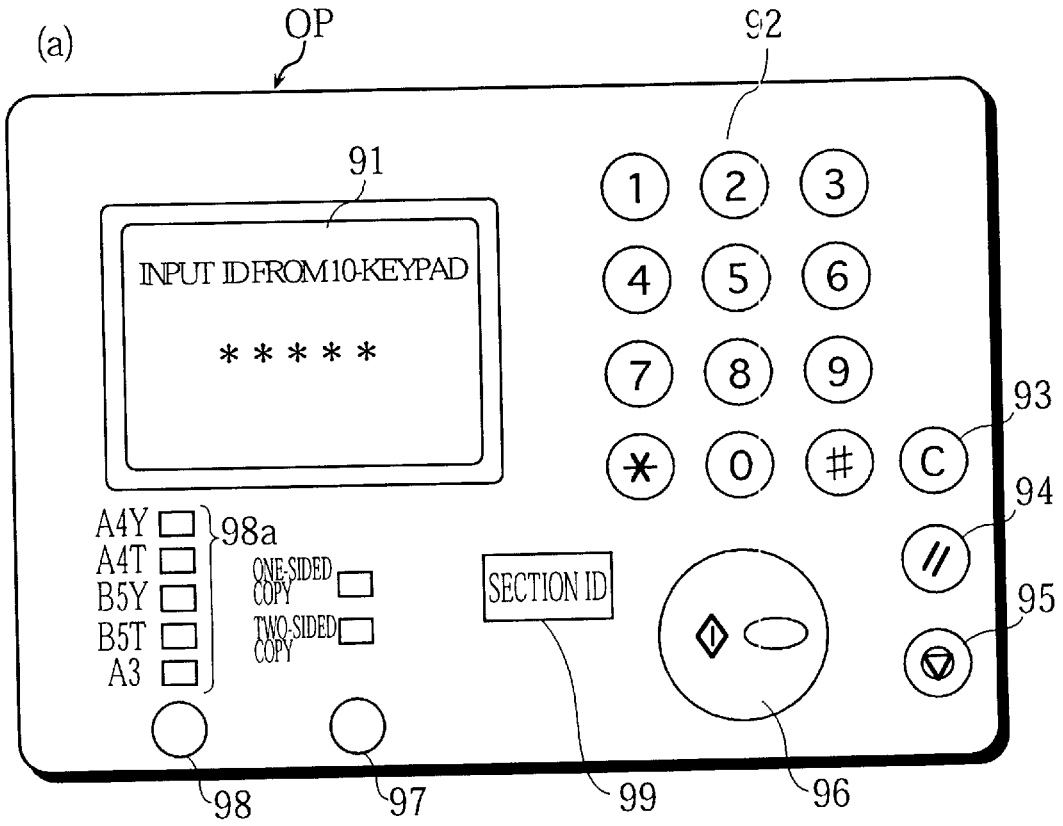
FIG. 2 shows the initial state of the operation panel of the copying machine.

An operation panel OP shown in FIG. 2 is provided on top of the copying machine 2 at the front. As shown in FIG. 2, the operation panel is provided with a liquid crystal touch panel 91, a 10-keypad 92 for inputting a numerical value such as the number of copies and the copy magnification, a clear key 93 for returning the number of copies to the standard value "1", a panel reset key 94 for returning the settings of the main copying machine unit 20 to initial standard values, a stop key 95 for stopping a copying operation, a start key 96 for starting a copying operation, a mode setting key 97 for setting either one-sided copy mode or two-sided copy mode, a paper size key 98 for selecting a paper sheet size, a paper display unit 98*a* for displaying a selected paper sheet size and the like, and an ID key 99 for inputting an ID before a copying operation is started.

The liquid crystal touch panel 91 comprises a liquid crystal display panel for displaying necessary messages and various keys, and a touch panel provided thereon. A user can input necessary settings and instructions by touching certain keys displayed on the panel.

Figure 3:
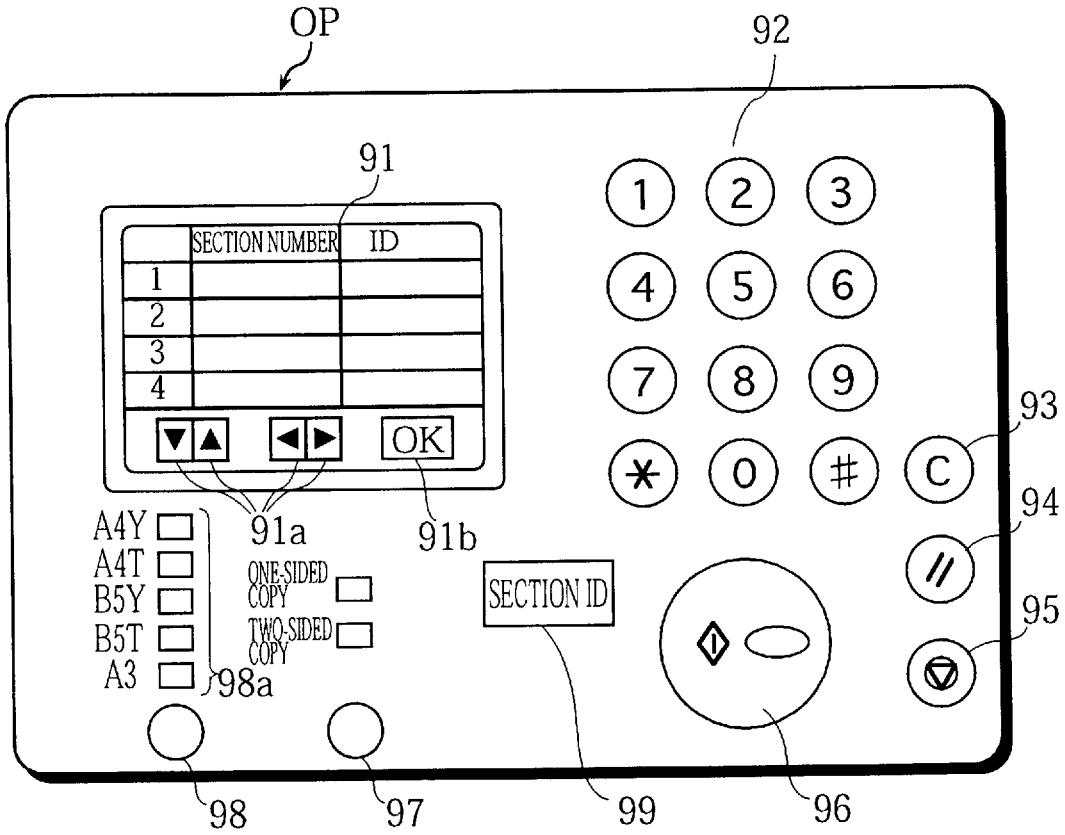
FIG. 3 shows the section number registration screen on the operation panel of the copying machine.

FIG. 3 shows a section number registration screen for registering a section number and a corresponding ID, both of which are assigned to a section which uses the copying machine 2. Note that a section number and an address number of the section monitor storage unit M1 which is described later (see FIG. 6A) are not related. Any number indicating a specific section can be used as the section number and may be composed of characters and signs in addition to numerals. The section number registration screen is activated by a predetermined operation such as the pushing of the ID key 99 twice or the pushing of a special switch provided on the apparatus.

In the section number registration screen, there is a section number column for registering section numbers and an ID column for registering corresponding IDs, cursor keys 91*a* for moving a cursor (not shown in the figure) to a certain position in the section number column or ID column, and an OK key 91*b* for determining an inputted section number and ID. A user moves the cursor key to an unregistered entry in the section number column by operating the cursor key 91*a* and inputs a section number of the section to which the user belongs from the 10-keypad 92. The user then moves the cursor to the entry in the ID column to the right of the entry in the section number column, inputs an ID from the 10-keypad 92, and pushes the OK key 91*b*. By doing so, the section number and the ID are registered in certain storage areas in the control unit 200 in the copying machine with the section number and the ID being related to each other. This is described in more detail later.

Figure 4:
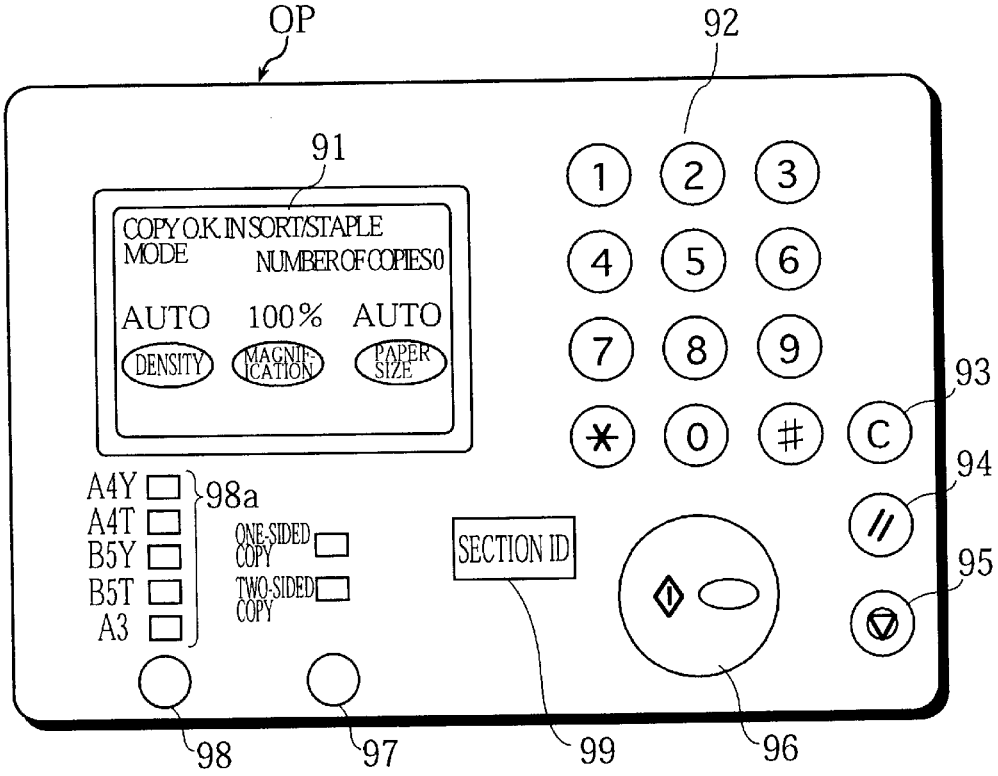
FIG. 4 shows the basic copying screen on the operation panel of the copying machine.

After the section number and the corresponding ID are registered as described above, the user can use the copying machine 2. More specifically, the liquid crystal touch panel 91 displays a message which asks the user to input an ID as shown in FIG. 2 in an initial state, and the operation commences with the input of the ID. After the user inputs the ID of the section to which the user belongs from the 10-keypad 92 and pushes the ID key 99, IDs registered in the control unit 200 are searched and the user is permitted to make copies in the case where an ID which matches the inputted ID is registered. After that, the image on the liquid crystal touch panel 91 changes to the basic copying screen as shown in FIG. 4 from which copying conditions can be inputted.

After the user inputs copying conditions such as the number of copies to be made, magnification, paper sheet size, and density from this image, the user pushes the start key 96 to start a copying operation.

The number of copies made by the user is accumulatively stored as count data, with the number of copies being related to the section number of the section to which the user belongs This is described in more detail later.

The section number and the count data are periodically transmitted to the host computer 1 via the public telephone line 3 and the count data of each section is summed up. After an operator provides a certain instruction from the keyboard 12, the cost which will be billed to each section is calculated and is outputted using the printer 13, and the bill for copying cost is transmitted from the service center to each section.

(2) Structure of Control System

Figure 5:
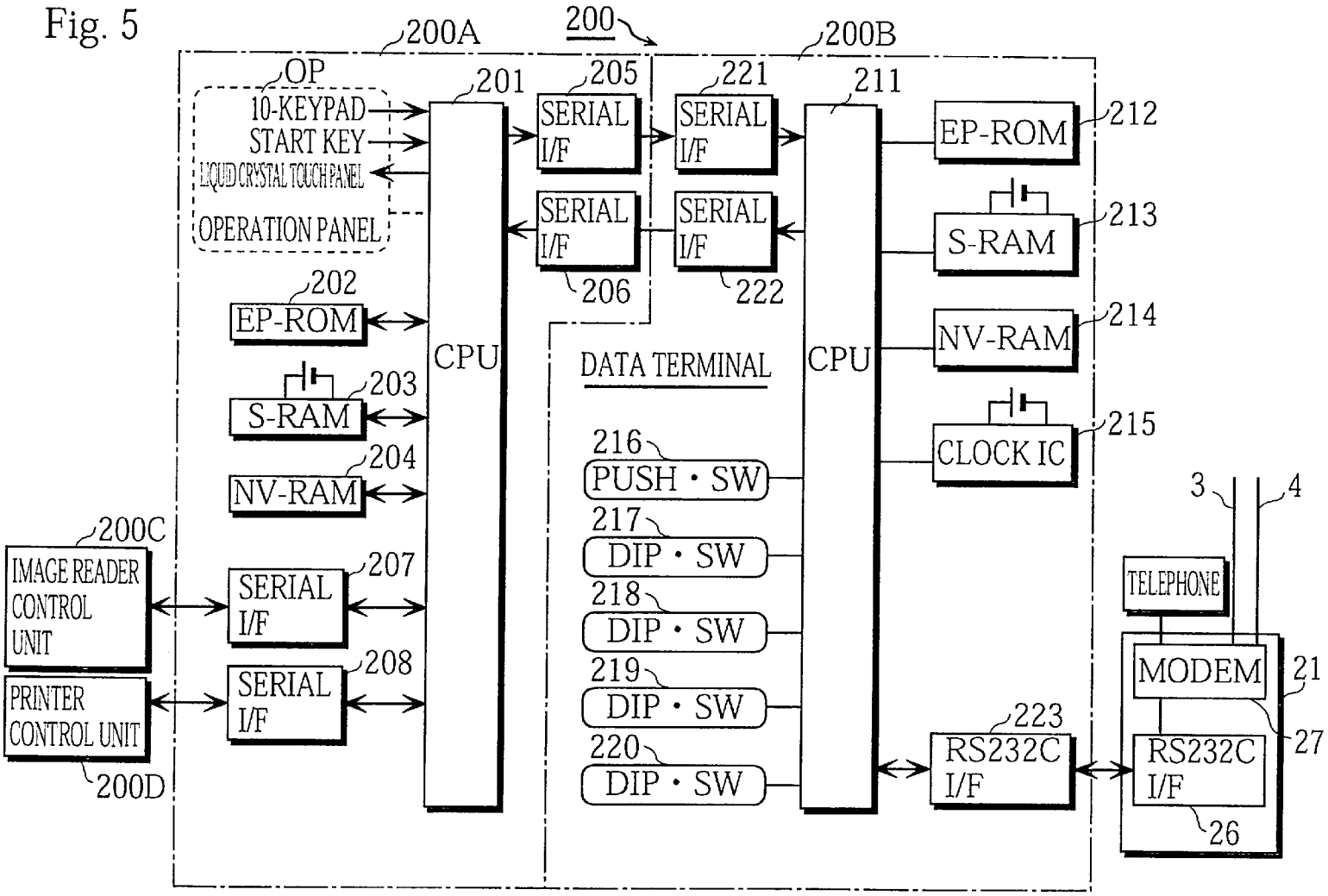
FIG. 5 is a block diagram showing the structure of the control unit in the copying machine.

The following is an explanation of control systems of the copying machine 2 and the host computer FIG. 5 is a block diagram showing the structure of the control unit 200 provided in the main copying machine unit 20. The control unit 200 mainly comprises a main control unit 200A for controlling copying operations of the copying machine 2, a data terminal control unit 200B for monitoring the number of copies made using the copying machine 2, an image reader control unit 200C for performing reading operations of an original document, and a printer control unit 200D for performing print operations onto paper sheets.

The main control unit 200A mainly comprises a CPU 201 and is provided with an EP-ROM 202 which stores a basic program necessary for controlling the CPU 201, an S-RAM 203 which is battery-backed and provides a work area for storing instructions from a user and operation states of each unit while the program is executed, serial I/Fs 205 and 206 for communicating with the data terminal control unit 200B, a serial I/F 207 for communicating with the image reader control unit 200C, and a serial I/F 208 for communicating with the printer control unit 200D.

The CPU 201 reads a panel display program, from the EP-ROM 202, for switching a screen displayed on the liquid crystal touch panel 91 and has the liquid crystal touch panel 91 display the ID input screen (see FIG. 2), the basic copying screen (see FIG. 4), and the section number registration screen (see FIG. 3), all of which are described above, as necessary.

Information about copying conditions set from the operation panel OP with the basic copying screen being displayed is transmitted to the image reader control unit 200C and the printer control unit 200D via serial I/Fs 207 and 208, respectively. These control units control a reading operation of an original document and a print operation, based on the received information.

The printer control unit 200D generates a count request each time one print is finished, and transmits the count request to the data terminal control unit 200B via the main control unit 200A.

The data terminal control unit 200B mainly comprises a CPU 211 and is provided with an EP-ROM 212 which stores a basic program, an S-RAM 213 which is battery-backed, and has a buffer for temporarily storing data during communication with the host computer 1 and various flag areas, an NV-RAM 214 for registering a section number described above and for performing other operations, a clock IC 215 which measures time for transmitting data to the host computer 1, a push switch 216 , DIP switches 217 to 220, serial I/Fs 221 and 222 for communicating with the main control unit 200A, and an RS232C I/F 223 for communicating with the host computer 1 and other copying machines via a modem device 21.

The EP-ROM 212 stores a program for registering a section number and an ID, a program for judging whether an inputted ID matches a registered ID, and a program for communicating with the host computer 1 via the modem device 21.

The NV-RAM 214 stores the section monitor storage unit M1 shown in FIG. 6A, the section monitor table T shown in FIG. 6B, an ordinary counter for counting the total number of copies of the copying machine 2, a counter for storing the number of paper jam occurrences which is taken into consideration when performing maintenance, and an ID which is assigned to each of the copying machines (hereinafter called "copying machine ID"). The NV-RAM 214 further stores copying machine IDs of other copying machines and the telephone number of the host computer 1.

In the present embodiment, the section monitor storage unit M1 shown in FIG. 6A has 200 storage areas and stores a section number and its count data (the number of copies) as a pair in successive areas in address number order. In other words, a total of 100 pairs of section numbers and count data can be stored. The section monitor table T shown in FIG. 6B is provided with areas for storing IDs and areas for storing address numbers of section numbers corresponding with the IDs in the section monitor storage unit M1.

The copying machine ID assigned to the copying machine 2 is stored in the NV-RAM 214 by setting the DIP switches 217–220 at a specific value assigned to the copying machine 2 and pushing the push switch 216. When data is transmitted to other copying machines 2 and the host computer 1, the copying machine ID is also transmitted so that receivers can easily recognize where the data came from.

The CPU 211 controls the above-described registration of a section number and an ID, receives an ID inputted by a user before a copying operation is started, determines whether the user is permitted to make copies by searching a matching ID registered in the section monitor table T in the NV-RAM 214, and transmits the determination to the main control unit 200A. The CPU 211 also performs count processing of the number of copies, based on the count requests transmitted from the printer control unit 200D via the main control unit 200A.

The CPU 211 further controls the communication with the host computer 1 and other copying machines 2 via the modem device 21. The modem device 21 comprises a modem 27 which is connected to the public telephone line 3 and the private line 4, and an RS232C I/F 26 which is connected to the RS232C I/F 223 of the data terminal control unit 200B. The modem device 21 executes data communication with other copying machines 2 via the private line 4 and with the host computer 1 via the public telephone line 3.

Figure 7:
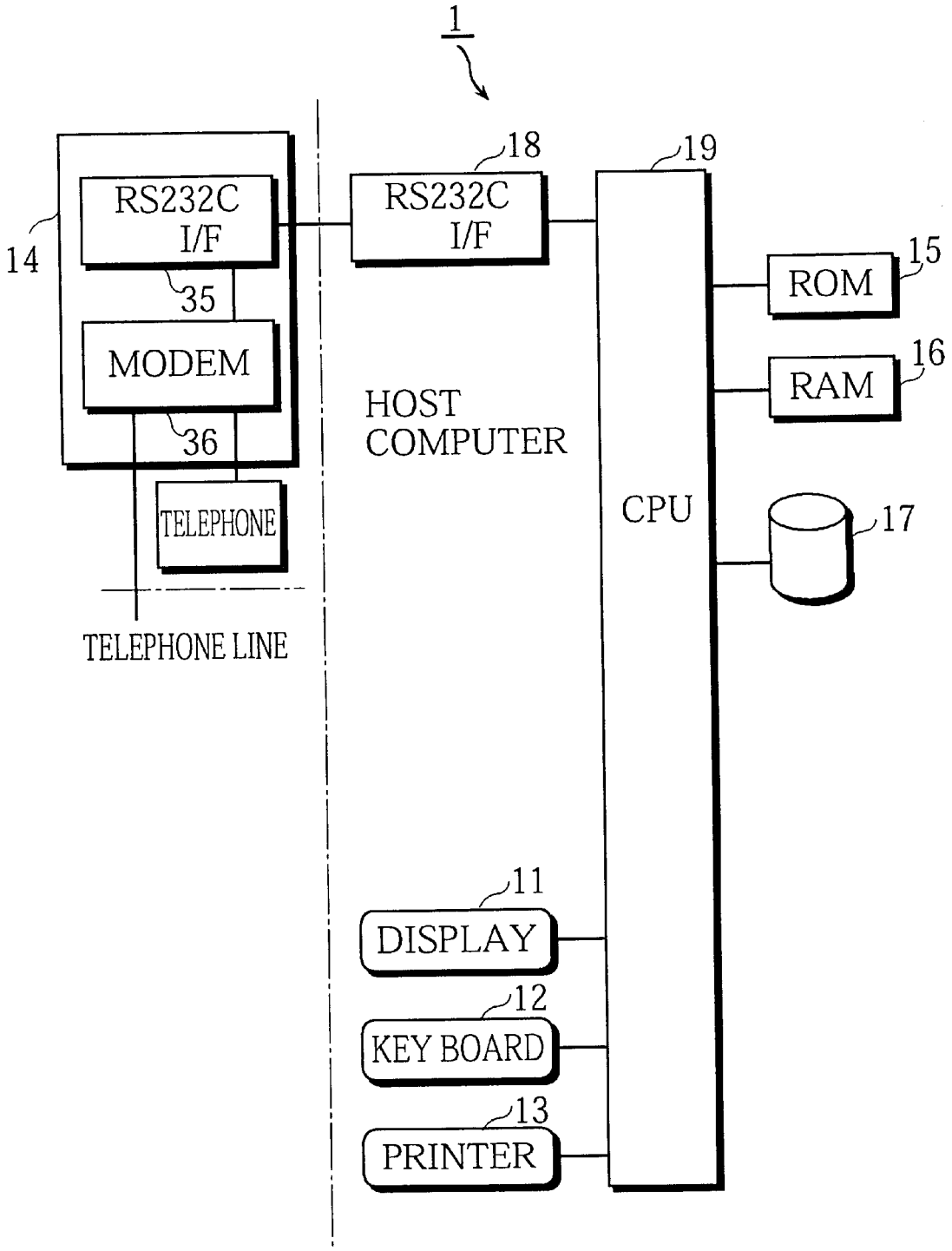
FIG. 7 is a block diagram showing the control system in a host computer.

The following is an explanation of the control system of the host computer FIG. 7 is a block diagram showing the structure of the host computer 1 As shown in FIG. 7, the host computer 1 mainly comprises a CPU 19 which is provided with a ROM 15 for storing a control program, a RAM 16 for providing a communication buffer and for providing a temporary storage area for various flags Connected with the CPU 19 are a hard disc drive 17 for storing the section monitor storage unit M2 for summing up the number of copies made by each of sections as shown in FIG. 8, and an RS232C I/F18 which is a communication interface.

The section monitor storage unit M2 shown in FIG. 8 is provided with storage areas for storing count data, with the count data being related to the section numbers of all sections. An example where there are 1000 sections is shown in FIG. 8. The host computer 1 receives a section number and its count data from each copying machine 2 via a modem device 14 comprising an RS232C I/F 35 and a modem 36, and accumulates and stores the count data in a count data storage area for the corresponding section number. Therefore, the number of copies made by each section using all copying machines is summed up.

(3) Control Operation of Data Terminal Control Unit 200B

The following is an explanation of control operation for monitoring the number of copies in the data terminal control unit 200B, with reference to a flowchart.

Figure 9:
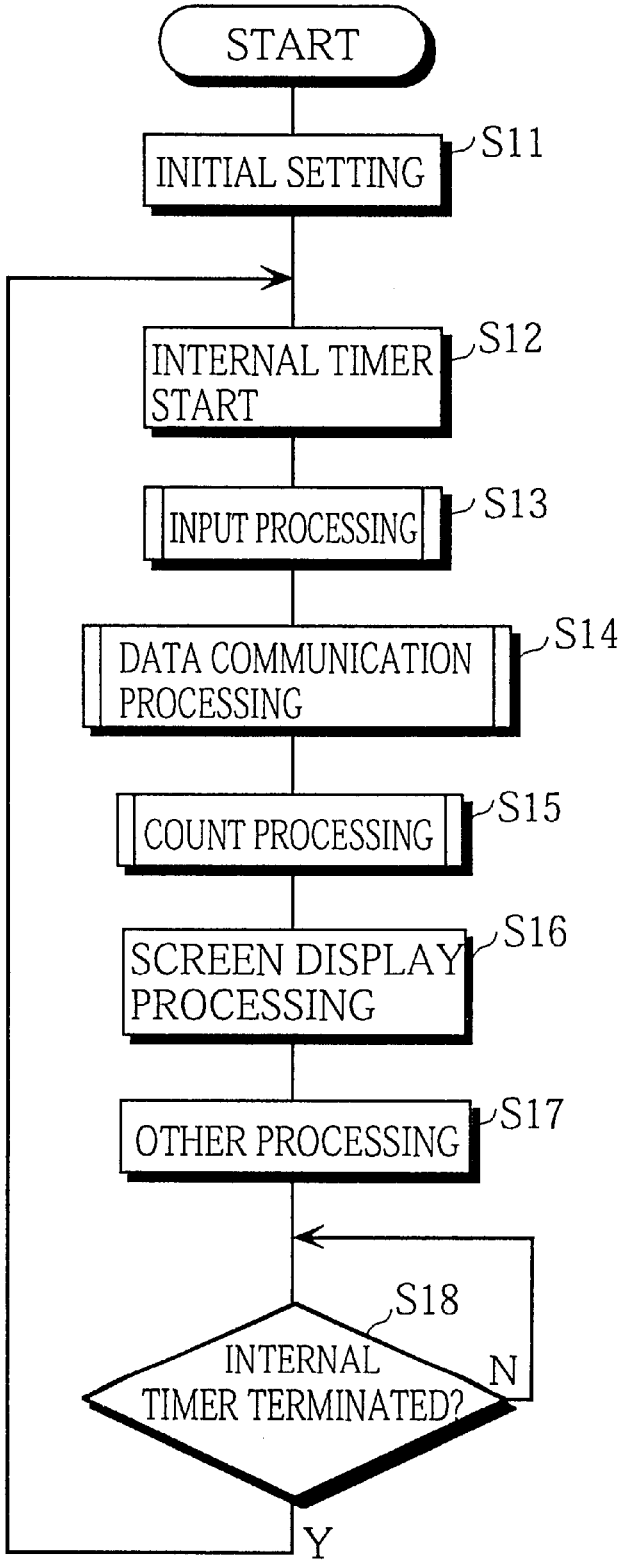
FIG. 9 is a flowchart showing the main processing of the copying machine.

FIG. 9 is a flowchart showing the main routine of control operation of the data terminal control unit 200B.

After being switched on, the CPU 211 of the data terminal control unit 200B reads an initialization program stored in the EP-ROM 212, initializes the work area of the S-RAM 213 (S11), starts to time using an internal timer, and monitors that the main routine is executed in a predetermined time period (S12 and S18).

After the internal timer starts to time, the following steps are executed in order: input processing for receiving inputs from various keys on the operation panel OP (S13); data communication processing for communicating data such as a section number, the number of copies, and an image data with the host computer 1 and other copying machines 2 (S14); count processing for counting the number of copies made by each section (S15); screen display processing for displaying various messages and the like on the operation panel OP (S16); and other processing (S17).

The following is a detailed explanation of the processing of S13–S15 described above.

Figure 10:
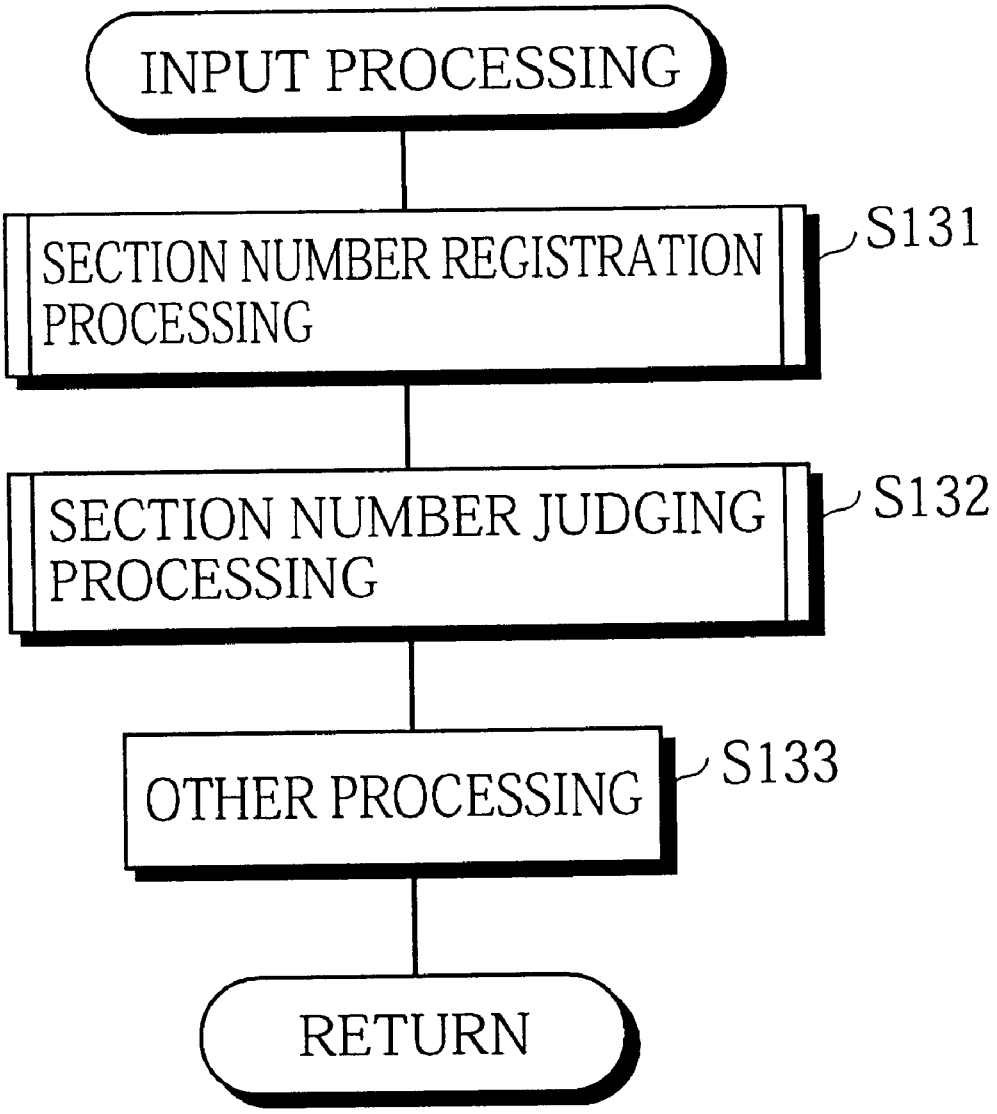
FIG. 10 is a flowchart showing the input processing subroutine shown in FIG. 9.

FIG. 10 is a flowchart showing the input processing subroutine (S13) in FIG. 9. The CPU 211 executes section number registration processing to register a section number and an ID, based on information transmitted from the CPU 201 (S131). The CPU 211 then compares an ID, which is inputted before a copying operation is started, with the registered IDs and judges whether copying is permitted. When copying is permitted, the CPU 211 performs section number judging processing to select a section number whose the number of copies will be counted (S132). After that, other processing, such as the setting of copying conditions, is executed (S133) and the system returns to the main routine.

Figure 11:
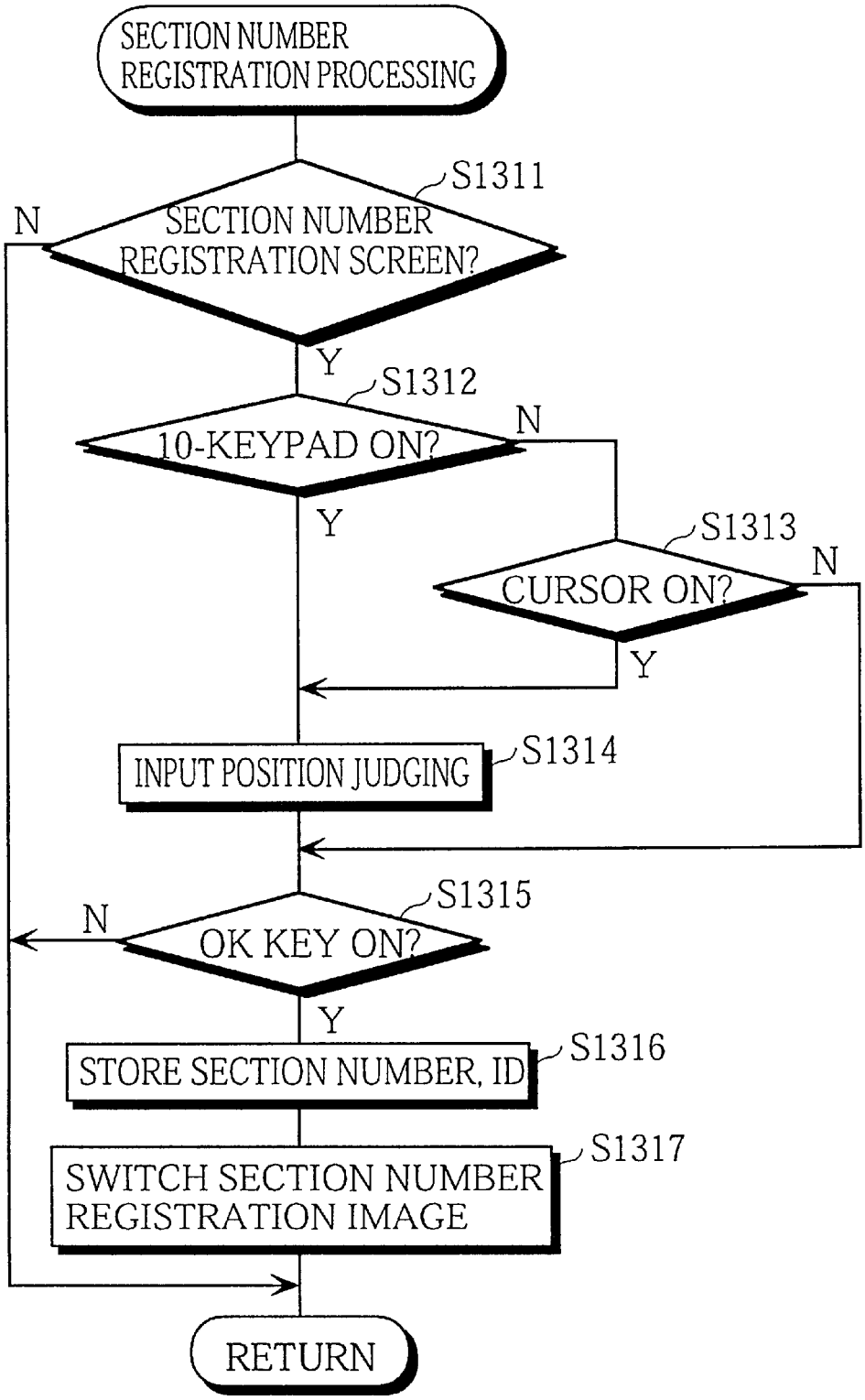
FIG. 11 shows the section number registration processing subroutine shown in FIG. 10.

FIG. 11 is a flowchart showing the section number registration processing subroutine (S131) in FIG. 10. The CPU 211 judges whether the liquid crystal touch panel 91 displays the section number registration screen shown in FIG. 3 (S1311). In the case where the section number registration screen is displayed, the CPU 211 judges whether the cursor keys 91*a* are touched and the 10-keypad 92 is pushed (S1312, S1313). The CPU 211 judges where to display a number inputted from the 10-keypad 92 according to the instruction from the cursor keys 91*a* if the cursor keys 91*a* are touched, whereas it is judged according to the initial setting if the cursor keys 91*a* are not touched (S1314).

When the OK key 91*b* is subsequently touched, the inputted section number and ID are stored in proper positions in the section monitor storage unit M1 (see FIG. 6A) and the section monitor table T (see FIG. 6B) (S1315, S1316). The CPU 201 is then instructed to switch the section number registration screen to the ID input image shown in FIG. 2 (S1317) and the system returns to the main processing.

By doing so, for instance, the section number "0012" is registered in the storage area whose address number is "0003" in the section monitor storage unit M1 in FIG. 6A, and the ID "OXOX" and the memory address "0003" of the section number are stored in the ID column and the section number memory address column, respectively, in the section monitor table T in FIG. 6B.

In the case where the section number registration screen is not displayed in S1311 or the OK key 91*b* is not ON in S1315, the system returns to the subroutine in FIG. 10.

Figure 12:
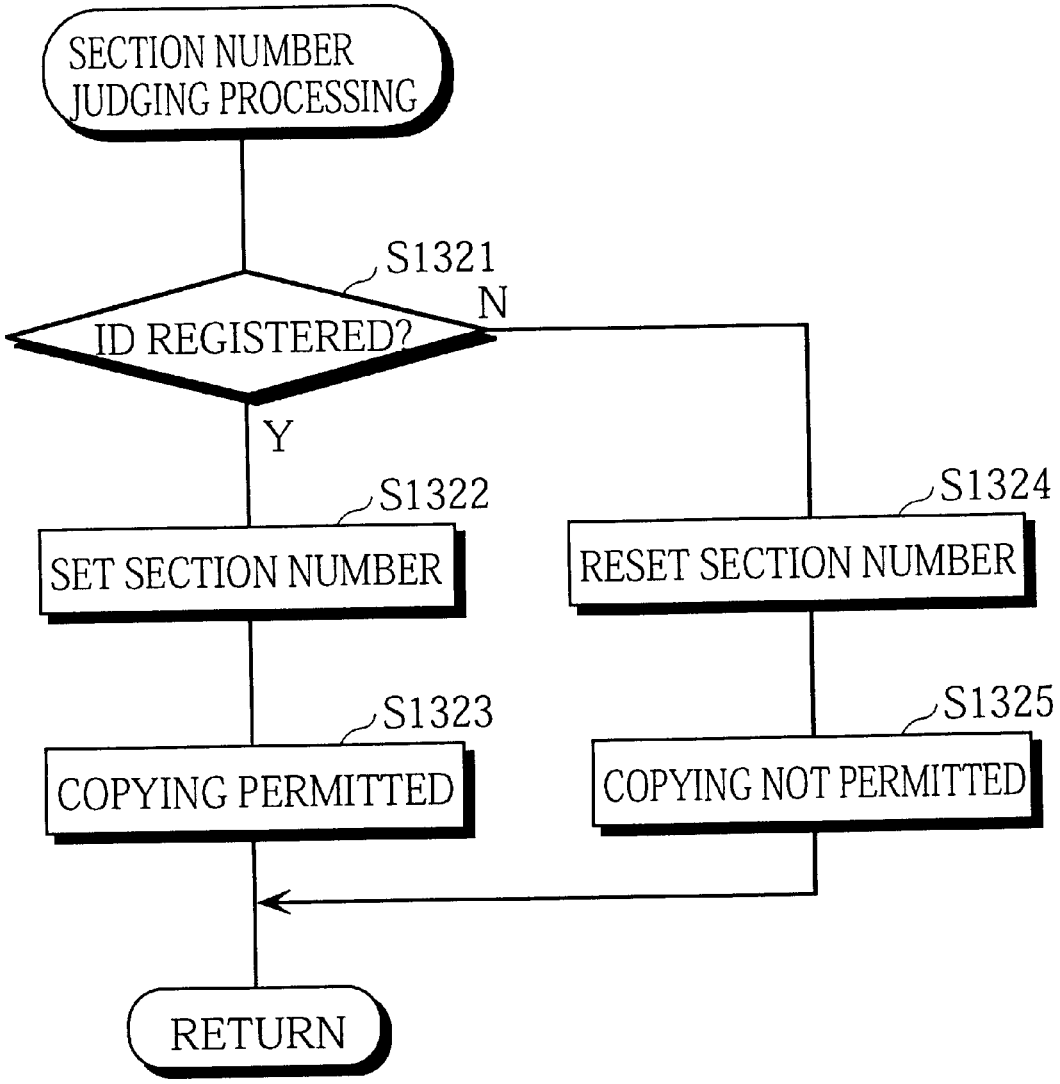
FIG. 12 shows the section number judging processing subroutine shown in FIG. 10.

FIG. 12 is a flowchart showing the section number judging processing subroutine (S132) in FIG. 10. The CPU 211 is informed, by the CPU 201, that an ID is inputted from the ID input image shown in FIG. 2 and judges whether the ID is registered in the section monitor table T (see FIG. 6B) (S1321). In the case where the ID is registered, a corresponding section number is set in a predetermined storage area (hereinafter called as "count section storage areas") in the S-RAM 213 (S1322), the CPU 201 is informed that copying is permitted (S1323), and the system returns to the subroutine in FIG. 10.

In the case where the inputted ID is not registered in S1321, the storage content of the count section storage area is reset to "0" (S1324), the CPU 201 is informed that copying is not permitted (S1325), and the system returns to the subroutine in FIG. 10.

Figure 13:
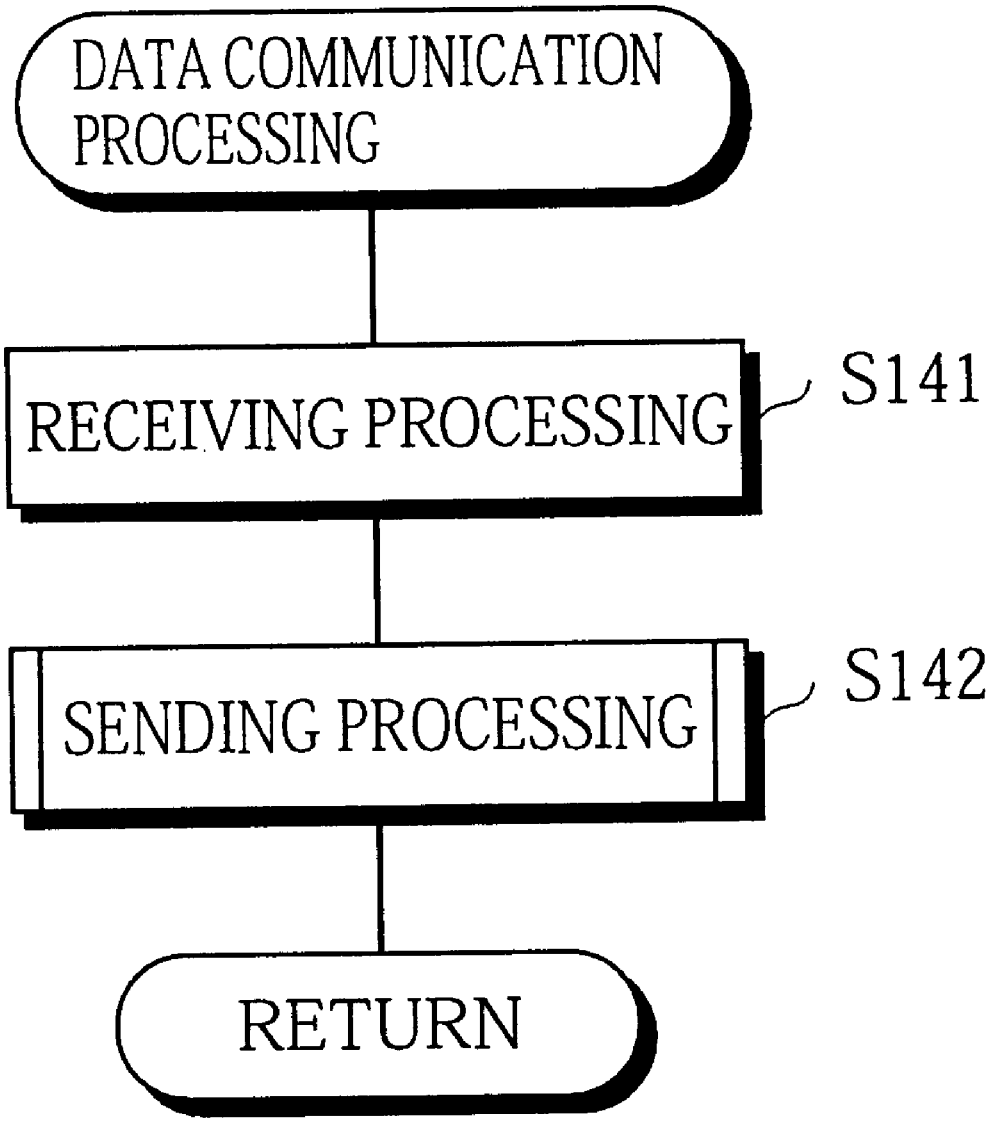
FIG. 13 shows the data communication processing subroutine shown in FIG. 9.

FIG. 13 is a flowchart showing the data communication processing subroutine (S14) in FIG. 9. In this data communication processing, reception processing for receiving data from the host computer 1 and other copying machines 2 (S141) and sending processing for transmitting data to the host computer 1 and the other copying machines 2 (S142) are executed, and the system returns to the main routine in FIG. 9.

Figure 14:
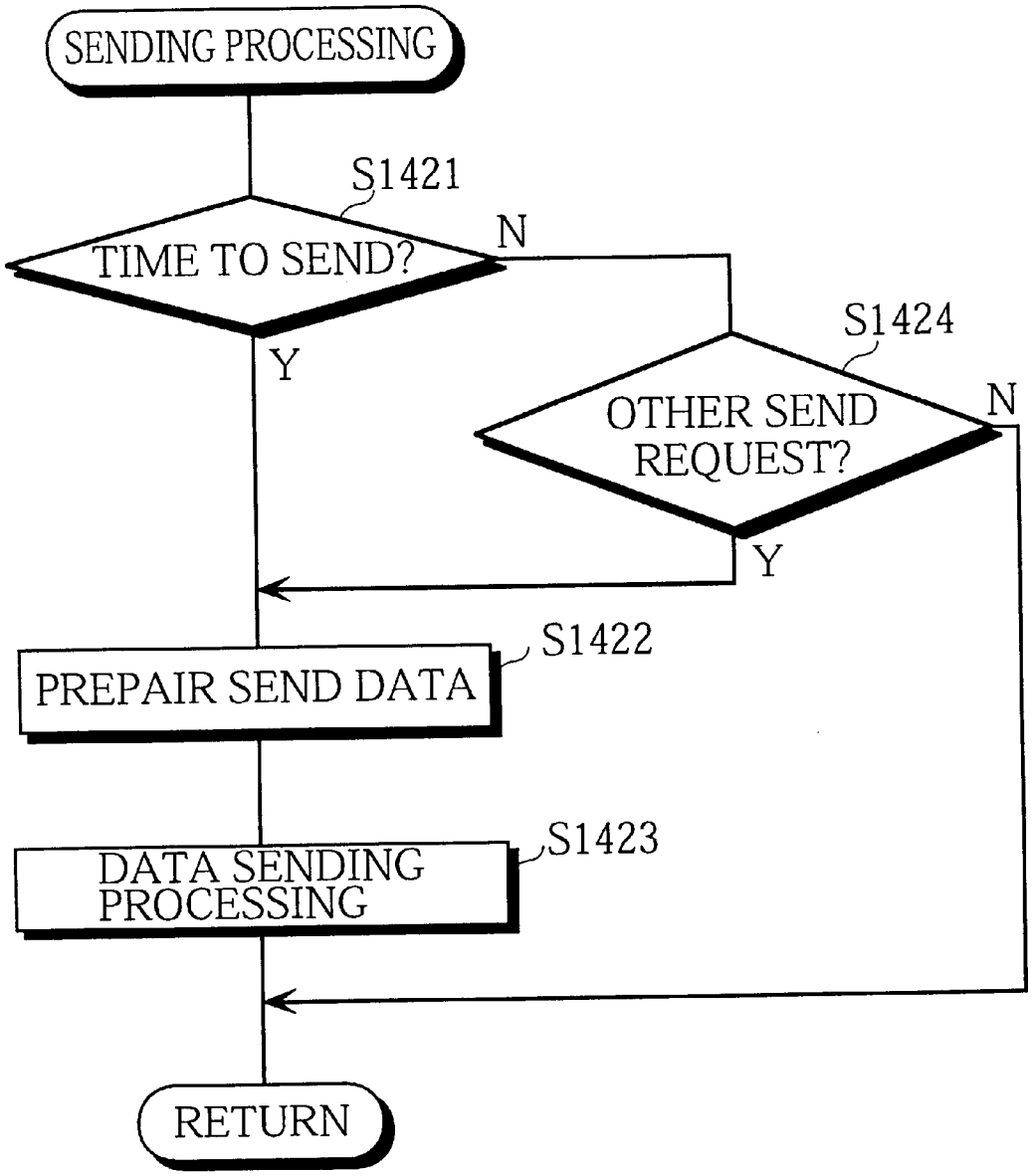
FIG. 14 shows the sending processing subroutine shown in FIG. 13.

FIG. 14 is a flowchart showing the sending processing subroutine (S142) shown in FIG. 13. The CPU 211 periodically reads time data from the clock IC 215 and judges whether a predetermined data transmission time set beforehand in the S-RAM 213 has been reached (S1421). If it is time to transmit data, all section numbers and their count data are read from the section monitor storage unit M1 in memory address order to generate the transmission data (S1422) and the transmission data is transmitted to the host computer 1 via the modem device 21 (S1423).

If it is not time to transmit data in S1421, the CPU 211 judges whether other transmission requests have been made, such as for the transmission of image data to other copying machines (S1424). If transmission of other data is requested, transmission data is generated according to the transmission request (S1422, S1423) and the system returns to the subroutine shown in FIG. 13. Not that if transmission of other data is not requested, the system returns directly to the main processing.

Figure 15:
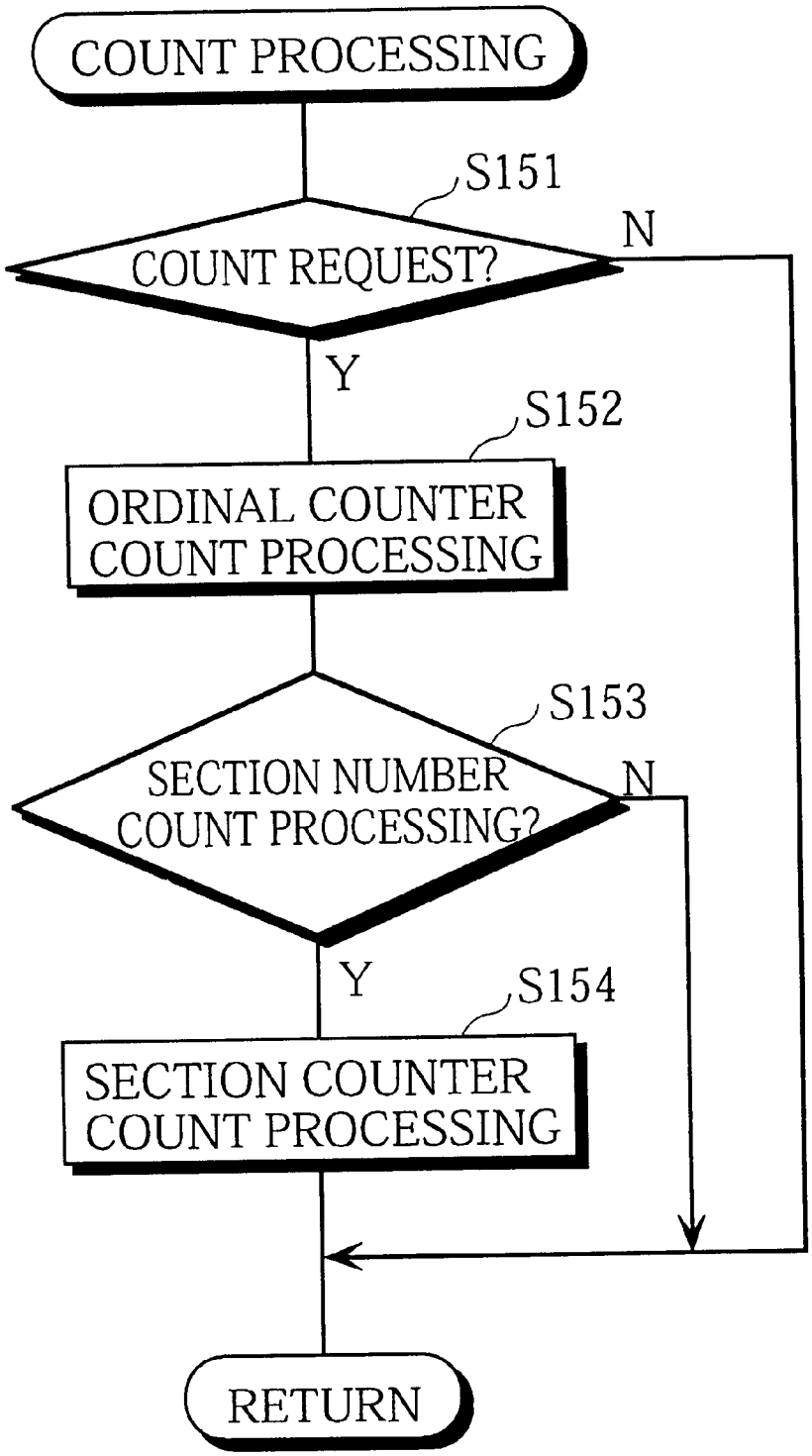
FIG. 15 shows the count processing subroutine shown in FIG. 9.

FIG. 15 is the flowchart showing the subroutine of count processing (S15) in FIG. 9. In this subroutine, the CPU 211 judges whether there is a count request (S151). As described above, this count request is a control signal which is generated by the printer control unit 200D each time a paper sheet has been printed and is transmitted to the CPU 211 via the CPU 201, and count processing is executed by the ordinary counter that counts the total number of copies (S152).

The CPU 211 then judges whether count processing will be executed for each section (S153). This judgement is made based on the storage content in the count section storage area in the S-RAM 213. More specifically, if a section number aside from "0" is set in the storage area (see S1322 in FIG. 12), the CPU 211 judges section number count processing should be executed; whereas if the section number has been reset and "0" is set in the storage area (see S1324 in FIG. 12), the CPU 211 judges the section number count processing is not to be executed.

If it is judged in S153 that the section number count processing should be executed, count data corresponding with the section number in the section monitor storage unit M1 is incremented (S154) and the system returns to the main routine. If there is no request to count in S151 or the section number count processing is not judged to be necessary in S153, the system returns directly to the main routine.

With the control operation of the data terminal control unit 200B as described above, the sections which may use a certain copying machine 2 are monitored, and up to 100 section numbers and IDs assigned to the sections can be registered. As a result, it can be judged whether copying is permitted, and the number of copies for each section number can be monitored. Each of other copying machines 2 can register section numbers of the sections monitored by each of the other copying machines 2. However, these section numbers are unique numbers which are not related to address numbers in the section monitor storage unit M1 in any of the copying machines 2. As a result, each section number will correspond to a same section in all of the copying machines 2 so that confusion will not arise when the number of copies made by each section is summed up by the host computer 1.

Note that if the total number of sections is 100 for the monitor method described above, the present invention will additionally require the storage capacity for storing one hundred unique section numbers when compared to the monitor method described in the related art. However, the conventional monitor method uses address numbers that correspond to all section numbers, meaning that an increase in the number of sections requires an increase in the number of addresses in every copying machine, which in turn means that the memory of every copying machine must be expanded. In the monitor method of the present invention, however, it is sufficient to only register in each copying machine the sections which are likely to use the copying machine in question, meaning that it is not necessary to register the entire increase in section numbers in each copying machine. This means the necessary increase in memory can be restricted.

(4) Control Operation of Host Computer

In S142, transmission processing (see FIG. 13, FIG. 14), the host computer 1 receives data (a section number and count data) which are transmitted periodically from each copying machine 2.

Figure 16A:
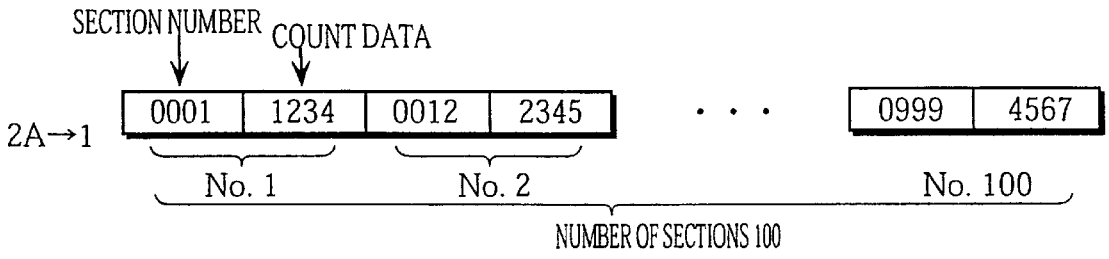
FIG. 16 shows the format of data transmitted from the copying machine to the host computer.
Figure 16B:
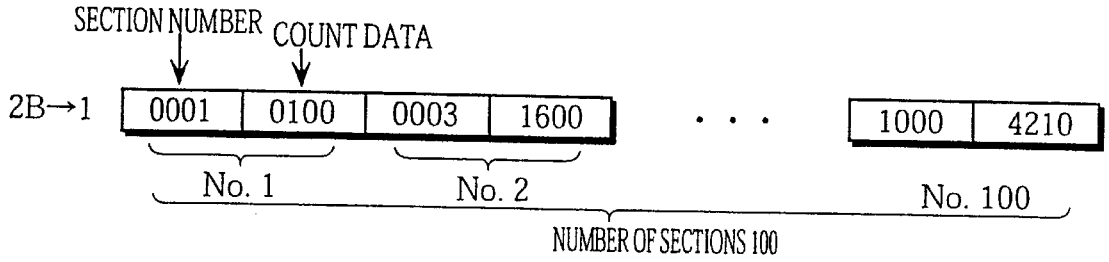
Figure 16C:
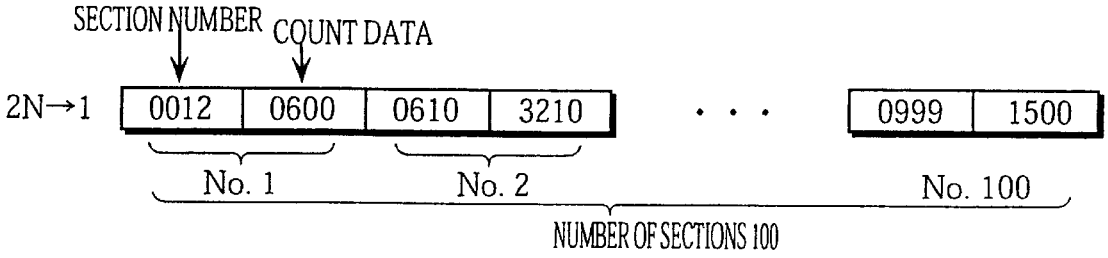

FIG. 16 is a schematic illustration of the content of the transmission data. As shown in FIG. 16, section numbers and their count data in the section monitor storage unit M1 are transmitted successively from copying machines 2 to the host computer 1 in memory address order.

As described above, the host computer 1 receives these transmission data and stores the number of copies of each section number in a predetermined storage area in the section monitor storage unit M1, thereby monitoring every number of copies made by each section.

(5) Modifications

The present invention has been described by way of the above embodiment, but it should be understood that the scope of the present invention is not limited to the above embodiment, and that the following modifications are possible.

1. In the above embodiment, an ID is inputted by pushing the 10-keypad. However, an ID recorded magnetically on a card can be read by a copying machine which is provided with a card reader.

2. In the present embodiment, pairs of inputted section numbers and count data are recorded successively in address order of the section monitor storage unit M1 (see FIG. 6A) However, a certain section number can be easily accessed using the memory address in the section monitor table T (see FIG. 6B) so that the positions which record each of section number do not need to be successive.

3. In the present embodiment, the printer control unit 200D generates a count request each time a paper sheet has been printed, and count data corresponding with a section number which uses the copying machine is incremented. More specifically, the count value is incremented one by one per a paper sheet regardless of the printed content.

However, count method is not limited to this. For instance, the count data can be incremented two by two per a paper sheet when a copying operation is expected to use more toner like a large paper sheet in size is used. In this case, the increment amount can be changed, based on information inputted from the operation panel, namely information about the paper sheet size inputted from the operation panel. In the case where a copying machine is operable in two-sided copy mode, count value can be incremented one by one in one-sided copy mode and 1.5 by 1.5 in two-sided copy mode. Because toner necessary for two pages is used but only one paper sheet is used in two-sided copy mode, the count value is incremented 1.5 by 1.5. In the case where a full-color copying machine is used, the increment amount of count value can be changed according to which mode is set, monochrome printing mode or color printing mode.

4. In the present invention, section numbers and their corresponding IDs are registered from the operation panel on the copying machine 2. However, section numbers and their corresponding IDs can be registered by storing them, beforehand, in the section monitor storage unit M1 in the NV-RAM 214 using an external device and placing the NV-RAM 214 in the copying machine 2. Therefore, it is not necessary to register section numbers and their corresponding IDs from the copying machine 2.

5. In the present invention, the method for monitoring the amount of image formation is applied to copying machines. However, the method also can be applied to any other image forming apparatus such as a laser printer.

What is claimed is:

1. An image forming apparatus comprising:

an image forming unit for forming an image on a sheet;

a storage unit for storing group codes, identification codes, and pieces of image formation frequency data in a plurality of predetermined address areas so that each of said group codes is related to one of said identification codes and to one of said pieces of image formation frequency data, wherein each of said group codes is a code indicating a user group, each of said identification codes is a unique code assigned to each user group, and each of said pieces of image formation frequency data is a piece of data indicating a frequency of image forming operations by each user group;

an input unit for receiving an identification code;

an identification code judging unit for judging whether said received identification code matches one of said identification codes stored in said storage unit;

a calculating unit for calculating, if said identification code is judged to match one of said identification codes stored in said storage unit, a frequency of image forming operations performed after said identification code is received by said input unit; and a rewriting unit for rewriting, according to said frequency of image forming operations calculated by said calculating unit, one of said pieces of image formation frequency data in said storage unit that is related to a user group corresponding to said received identification code.

2. The image forming apparatus defined in claim 1, wherein said storage unit includes:

a monitor memory, having a plurality of address areas, for storing said group codes and said pieces of image formation frequency data in said plurality of address areas, wherein each pair of a group code and a piece of image formation frequency data having relation to each other is stored in a pair of address areas located according to a predetermined relation; and an identification code table for showing one of a first combination and a second combination, said first combination being a relation between said identification codes and addresses in said monitor memory of said group codes, said second combination being a relation between said identification codes and addresses in said monitor memory of said pieces of image formation frequency data.

3. The image forming apparatus defined in claim 2, wherein each pair of said group code and said piece of image formation frequency data is stored in successive address areas.

4. The image forming apparatus defined in claim 1, wherein said input unit receives a group code and an identification code, and said image forming apparatus further includes:

a registration unit for storing said received group code and said received identification code into said storage unit so that said received group code is related to said received identification code.

5. The image forming apparatus defined in claim 4 further comprising a plurality of input keys, wherein said identification code judging unit is placed in an operable state by a first operation with said plurality of input keys, and said registration unit is placed in an operable state by a second operation with said plurality of input keys.

6. The image forming apparatus defined in claim 1, wherein each of said pieces of image formation frequency data indicates a number of images formed by said image forming unit for each user group, and said calculating unit calculates said number of images.

7. The image forming apparatus defined in claim 6, wherein each of said pieces of image formation frequency data indicates a total number of images formed by said image forming unit for each user group.

8. The image forming apparatus defined in claim 1, wherein said identification code judging unit only allows a use of said image forming apparatus when said received identification code is judged to match one of said identification codes stored in said storage unit.

9. The image forming apparatus defined in claim 1 further comprising:

a transmission unit for transmitting data to an external apparatus; and a transmission control unit for having said transmission unit transmit related pairs of said group codes and said pieces of image formation frequency data to said external apparatus so that said group codes are respectively related to said pieces of image formation frequency data.

10. The image forming apparatus defined in claim 9, wherein said transmission unit includes a modem.

11. The image forming apparatus defined in claim 1, wherein said storage unit defined in claim 1 includes a non-volatile memory.

12. An image formation frequency calculating apparatus for calculating a frequency of image forming operations by an image forming apparatus, said image formation frequency calculation apparatus comprising:

a storage unit for storing group codes, identification codes, and pieces of image formation frequency data in a plurality of predetermined address areas so that each of said group codes is related to one of said identification codes and to one of said pieces of image formation frequency data, wherein each of said group codes is a code indicating a user group, each of said identification codes is a unique code assigned to each user group, and each of said pieces of image formation frequency data is a piece of data indicating said frequency of image forming operations by each user group;

an input unit for receiving an identification code;

an identification code judging unit for judging whether said received identification code matches one of said identification codes stored in said storage unit;

a calculating unit for calculating, if said identification code is judged to match one of said identification codes stored in said storage unit, a frequency of image forming operations performed after said identification code is received by said input unit; and a rewriting unit for rewriting, according to said frequency of image forming operations calculated by said calculating unit, one of said pieces of image formation frequency data in said storage unit that is related to a user group corresponding to said received identification code.

13. The image formation frequency calculating apparatus defined in claim 12, wherein said storage unit includes:

a monitor memory, having a plurality of address areas, for storing said group codes and said pieces of image formation frequency data in said plurality of address areas, wherein each pair of a group code and a piece of image formation frequency data having relation to each other is stored in a pair of address areas located according to a predetermined relation; and an identification code table for showing one of a first combination and a second combination, said first combination being a relation between said identification codes and addresses in said monitor memory of said group codes, said second combination being a relation between said identification codes and addresses in said monitor memory of said pieces of image formation frequency data.

14. The image formation frequency calculating apparatus defined in claim 13, wherein each pair of said group code and said piece of image formation frequency data is stored in successive address areas.

15. The image formation frequency calculating apparatus defined in claim 12, wherein said input unit receives a group code and an identification code, and said image formation frequency calculating apparatus further comprises:

a registration unit for storing said received group code and said received identification code into said storage unit so that said received group code is related to said received identification.

16. The image formation frequency calculating apparatus defined in claim 15 further comprising a plurality of input keys, wherein said identification code judging unit is placed in an operable state by a first operation with said plurality of input keys, and said registration unit is placed in an operable state by a second operation with said plurality of input keys.

17. The image formation frequency calculating apparatus defined in claim 12, wherein each of said pieces of image formation frequency data indicates a number of images formed by said image forming unit for each user group, and said calculating unit calculates said number of images.

18. The image formation frequency calculating apparatus defined in claim 17, wherein each of said pieces of image formation frequency data indicates a total number of images formed by said image forming apparatus for each user group.

19. The image formation frequency calculating apparatus defined in claim 12, wherein said identification code judging unit only allows a use of said image forming apparatus when said received identification code is judged to match one of said identification codes stored in said storage unit. of image formation frequency data to said external apparatus so that said group codes are respectively related to said pieces of image formation frequency data, wherein said monitor apparatus comprises:

a reception unit for receiving data from said plurality of image forming apparatuses;

a total storage unit for storing said group codes and corresponding pieces of total image formation frequency data, wherein each of said pieces of total image formation frequency data is a piece of data indicating a frequency of use of all said image forming apparatuses by each user group;

a total calculating unit for calculating a total by summing up said image formation frequency data of each user group which is transmitted from each of said plurality of image forming apparatuses, and a total rewriting unit for rewriting, according to said total calculated by said total calculating unit, each of said pieces of total image formation frequency data in said total storage unit respectively corresponding to each of said group codes.

20. The image formation frequency calculating apparatus defined in claim 12 further comprising:

a transmission unit for transmitting data to an external apparatus; and a transmission control unit for having said transmission unit transmit related pairs of said group codes and said pieces of image formation frequency data to said external apparatus so that said group codes are respectively related to said pieces of image formation frequency data.

21. The image formation frequency calculating apparatus defined in claim 20, wherein said transmission unit includes a modem.

22. The image formation frequency calculating apparatus defined in claim 12, wherein said storage unit includes a non-volatile memory.

23. An image formation monitor system comprising a plurality of image forming apparatuses and a monitor apparatus for monitoring said plurality of image forming apparatuses, wherein said plurality of image forming apparatuses each comprise:

an image forming unit for forming an image on a sheet, a storage unit for storing group codes, identification indicates a number of images formed by each user group using all of said plurality of image forming apparatuses.

24. The image formation monitor system defined in claim 23, wherein each of said pieces of image formation frequency data indicates a total number of images formed by each user group using said plurality of image forming apparatuses, and said piece of total image formation frequency data codes, and pieces of image formation frequency data in a plurality of predetermined address areas so that each of said group codes is related to one of said identification codes and to one of said pieces of image formation frequency data, wherein each of said group codes is a code indicating a user group, each of said identification codes is a unique code assigned to each user group, and each of said pieces of image formation frequency data is a piece of data indicating a frequency of image forming operations by each user group;

an input unit for receiving an identification code;

an identification code judging unit for judging whether said received identification code matches one of said identification codes stored in said storage unit, a calculating unit for calculating, if said identification code is judged to match one of said identification codes stored in said storage unit, a frequency of image forming operations performed after said identification code is received by said input unit;

a rewriting unit for rewriting, according to said frequency of image forming operations calculated by said calculating unit, one of said pieces of image formation frequency data in said storage unit that is related to a user group corresponding to said received identification code;

a transmission unit for transmitting data to said monitor apparatus; and a transmission control unit for having said transmission unit transmit related pairs of said group codes and said pieces.

25. A method for calculating a frequency of image forming operations by an image forming apparatus, said method comprising:

a code registration step for registering group codes and identification codes in a memory;

an identification code input receiving step for receiving an identification code from a user;

an identification code judging step for judging whether said received identification code matches one of said identification codes registered in said memory;

an image formation frequency calculation step for calculating, if said identification code is judged to match one of said identification codes stored in said memory, a frequency of image forming operations performed after said identification code is received; and an image formation frequency storage step for storing in said memory said frequency of image forming operations calculated in said image formation frequency calculation step so that said frequency of image forming operations is related to one of said group codes that corresponds to said identification code.

26. The method defined in claim 25 further comprising:

an image formation permission step for permitting use of said image forming apparatus only when said received identification code is judged to match one of said identification codes stored in said memory.

27. The method defined in claim 25 further comprising:

a transmission step for transmitting said frequency of image forming operations in said memory and a corresponding one of said group codes to an external apparatus.

* * * * *

UNITED STATES PATENT AND TRADEMARK OFFICE

CERTIFICATE OF CORRECTION

PATENT NO. : 5,903,801
DATED : May 11, 1999
INVENTOR(S) : Hidenobu Nakamura

It is certified that error appears in the above-identified patent and that said Letters Patent is hereby corrected as shown below:

Column 13, claim 19,
Delete lines 5-26, starting with "of image formation frequently....." and ending with ".....said group codes.";

Column 14, claim 23,
Lines 9-11, delete "indicates a number of images formed by each user group using all of said plurality of image forming apparatuses." and insert -- codes, and pieces of image formation frequency data in a plurality of predetermined address areas so that each of said group codes is related to one of said identification codes and to one of said pieces of image formation frequency data, wherein each of said group codes is a code indicating a user group, each of said identification codes is a unique code assigned to each user group, and each of said pieces of image formation frequency data is a piece of data indicating a frequency of image forming operation by each user group;

an input unit for receiving an identification code;

an identification code judging unit for judging whether said received identification code matches one of said identification codes stored in said storage unit, a calculating unit for calculating, if said identification code is judged to match one of said identification codes stored in said storage unit, a frequency of image forming operations performed after said identification code is received by said input unit;

a rewriting unit for rewriting, according to said frequency of image forming operations calculated by said calculating unit, one of said pieces of image formation frequency data in said storage unit that is related to a user group corresponding to said received identification code;

a transmission unit for transmitting data to said monitor apparatus; and a transmission control unit for having said transmission unit transmit related pairs of said group codes and said pieces of image formation frequency data to said external apparatus so that said group codes are respectively related to said pieces of image formation frequency data, wherein said monitor apparatus comprises:

a reception unit for receiving data from said plurality of image forming apparatuses;

a total storage unit for storing said group codes and corresponding pieces of total image formation frequency data, wherein each of said pieces of total image formation frequency data is a piece of data indicating a frequency of use of all said image forming apparatuses by each user group;

a total calculating unit for calculating a total by summing up said image formation frequency data of each user group which is transmitted from each said plurality of image

UNITED STATES PATENT AND TRADEMARK OFFICE

CERTIFICATE OF CORRECTION

PATENT NO. : 5,903,801
DATED : May 11, 1999
INVENTOR(S) : Hidenobu Nakamura

It is certified that error appears in the above-identified patent and that said Letters Patent is hereby corrected as shown below:

forming apparatuses, and a total rewriting unit for rewriting, according to said total calculated by said total calculating unit, each of said pieces of total image formation frequency data in said total storage unit respectively corresponding to each of said group codes. --.

Column 14, claim 24,

Delete lines 7 –37, starting with "codes, and pieces of image formation frequency data....." and ending with ".....said group codes and said pieces.", and insert -- indicates a number of images formed by each user group using all of said plurality of image forming apparatuses. --.

Signed and Sealed this

Second Day of April, 2002

*Attest:*

*Attesting Officer*

JAMES E. ROGAN
*Director of the United States Patent and Trademark Office*